US008579000B2

(12) United States Patent
Yen

(10) Patent No.: US 8,579,000 B2
(45) Date of Patent: Nov. 12, 2013

(54) AUTOMATIC ROTATION TYPE CORRECTION TAPE STRUCTURE

(75) Inventor: Ming-Hua Yen, New Taipei (TW)

(73) Assignee: Mcaide Enterprise Co., Ltd., New Taipei (TW)

( * ) Notice: Subject to any disclaimer, the term of this patent is extended or adjusted under 35 U.S.C. 154(b) by 53 days.

(21) Appl. No.: 13/407,767

(22) Filed: Feb. 29, 2012

(65) Prior Publication Data

US 2012/0227908 A1 Sep. 13, 2012

(30) Foreign Application Priority Data

Mar. 11, 2011 (TW) ..... 100204393 U

(51) Int. Cl.
*B32B 37/26* (2006.01)
*B26F 3/02* (2006.01)
*B43L 19/00* (2006.01)

(52) U.S. Cl.
USPC ..... 156/577; 156/527; 156/579; 118/76; 118/200; 118/257; 242/588; 242/588.2; 242/588.3; 242/588.6; 242/160.2; 242/160.4; 206/411; 401/110; 401/116

(58) Field of Classification Search
USPC ..... 156/523, 527, 538, 540, 547, 577, 579; 118/76, 200, 257; 225/46; 242/160.2, 242/160.4, 170, 171, 588, 588.2, 588.3, 242/588.6; 206/411
See application file for complete search history.

(56) References Cited

U.S. PATENT DOCUMENTS

| | | | | |
|---|---|---|---|---|
| 7,083,348 | B2 * | 8/2006 | Watanabe et al. | 401/17 |
| 2004/0028461 | A1 * | 2/2004 | Watanabe et al. | 401/195 |
| 2011/0000623 | A1 * | 1/2011 | Wu | 156/579 |

FOREIGN PATENT DOCUMENTS

| | | | |
|---|---|---|---|
| WO | 99/62807 | A1 | 12/1999 |
| WO | 2007/144299 | A1 | 12/2007 |

* cited by examiner

*Primary Examiner* — Mark A Osele
(74) *Attorney, Agent, or Firm* — Leong C. Lei

(57) ABSTRACT

An automatic rotation type correction tape structure comprises an outer casing, an inner casing and a tape delivery module. The outer casing has an opening and a circular top abutting surface formed inside the outer casing and proximate to the opening. The inner casing is movably installed in the outer casing and has an engaging structure corresponding to the inner casing, such that the inner casing can be rotated axially with respect to the outer casing. The tape delivery module is installed in the inner casing and has a tape guiding spout at an end of the tape deliver module. When use, the tape guiding spout is pressed to drive the inner casing to rotate axially in the outer casing in order to adjust an operating angle and improve the convenience of the use.

12 Claims, 6 Drawing Sheets

AUTOMATIC ROTATION TYPE CORRECTION TAPE STRUCTURE

CROSS-REFERENCE TO RELATED APPLICATIONS

This non-provisional application claims priority under 35 U.S.C. §119(a) on Patent Application No(s). 100204393 filed in Taiwan, R.O.C. on Mar. 11, 2011, the entire contents of which are hereby incorporated by reference.

BACKGROUND OF THE INVENTION

1. Field of the Invention

The present invention relates to the technical field of typographic error correction tools, in particular to an automatic rotation type correction tape structure capable of automatically rotating the structure and changing the using direction of the correction tape according to the using angle.

2. Description of the Related Art

Typographical errors are common in writing documents or letters, and correction tools such as erasers, correction liquids or correction tapes are provided for altering or covering erroneous texts or figures to facilitate rewriting the documents and letters.

The correction tape does not damage the surface fiber of paper or require any drying time of the correction liquid. In general, the correction tape includes a casing and a tape guiding spout installed at a front end of the casing. The casing includes a tape delivery module installed therein, and the tape delivery module comprises a tape feeding wheel and a tape winding wheel connected to one another and provided for guiding and storing a correction tape member, and the correction tape member is wound through the tape guiding spout. When use, a force is applied to attach the correction tape member onto a surface to cover the wrong words or figures, and rewrite the words or re-draw the figures on the surface of the correction tape member.

However, most correction tape devices available in the market can only be used with one operating angle or a slightly adjusted inclination of the tape guiding spout, but users cannot make a significant change to the required operating angle, and thus causing tremendous inconvenience.

In view of the problems of the conventional correction tape devices, PCT Pat. Nos. WO1999/62807 and WO2007/144299 A1 disclose a correction tape structure capable of automatically adjusting the attaching angle of the correction tape member according to the required operating angle, wherein a tape delivery module is axially installed in an outer casing, and a tape guiding spout is formed at an end of the tape delivery module, and a plate structure with a pivot portion is disposed at the other end of the tape deliver module, and the pivot portion is pivotally installed in a pivot slot formed at an end of the outer casing, such that the tape delivery module is axially and movably installed in the outer casing. Therefore, a force is applied to press the tape guiding spout, so that the tape delivery module automatically adjust the axial rotating angle in the outer casing, and the tape guiding spout is aligned evenly with the plane to attach the correction tape member onto the plane flatly. However, users must apply a certain force to change the using angle of the tape delivery module, and a position of the tape delivery module proximate to the tape guiding spout (which is the contact position between the outer casing and the tape delivery module) receives the largest force, and the plate structure of the tape delivery module hardly can provide an effective supporting effect, so that the rotation will become unsmooth or even result in an insufficient strength to affect the service life of the correction tape devices. Therefore, these conventional correction tapes cannot be popular.

SUMMARY OF THE INVENTION

In view of the problems of the prior art, it is a primary objective of the present invention to provide a convenient automatic rotation type correction tape structure capable of automatically changing the using angle according to a user's operating posture to improve the convenience of use significantly.

To achieve the foregoing objective, the present invention provides an automatic rotation type correction tape structure, comprising: an outer casing, being a tubular structure with a closed end, and having an opening and a circular top abutting surface formed inside the outer casing proximate to the opening; an inner casing, movably installed in the outer casing, and the inner casing having an engaging structure corresponding to the top abutting surface and the engaging structure abutting the top abutting surface, such that the inner casing can be axially rotated with respect to the outer casing, and the inner casing has a containing space therein; and a tape delivery module, installed in the containing space of the inner casing, and including: at least one pair of winding wheels, installed at an end of the inner casing and linked with each other to rotate synchronously; a tape guiding spout, installed on a side of the inner casing and passed out from the inner casing and the outer casing, and the tape guiding spout having an oblique plane portion; and a correction tape, having two ends wound around the winding wheels respectively, and wound through the tape guiding spout. When the tape guiding spout is pressed, the tape delivery module and the inner casing are driven to rotate axially and synchronously in the outer casing to change the using angle to fit the user's operating posture, so as to improve the convenience of use significantly.

Another objective of the present invention is to provide a pressing device combined with the automatic rotation type correction tape structure, so that the automatic rotation type correction tape structure can have the storage or extending functions after the structure is pressed and improve the functionality of the invention.

To achieve the aforementioned objectives, the present invention further comprises a pressing device installed on the outer casing, and the pressing device has an outer tube, a top rod and a press key, and the top rod is movably passed inside the outer tube, and the press key is disposed at an end of the top rod, and the other end of the top rod is coupled to the inner casing, such that after the press key is pressed, the top rod is linked to push the inner casing to move, and the tape guiding spout is passed out from the opening of the outer casing to improve the convenience of use.

The technical content of the present invention will become apparent with the detailed description of preferred embodiments and the illustration of related drawings as follows.

DETAILED DESCRIPTION OF THE PREFERRED EMBODIMENTS

The technical contents of the present invention will become apparent with the detailed description of preferred embodiments and the illustration of related drawings as follows.

Figure 1:
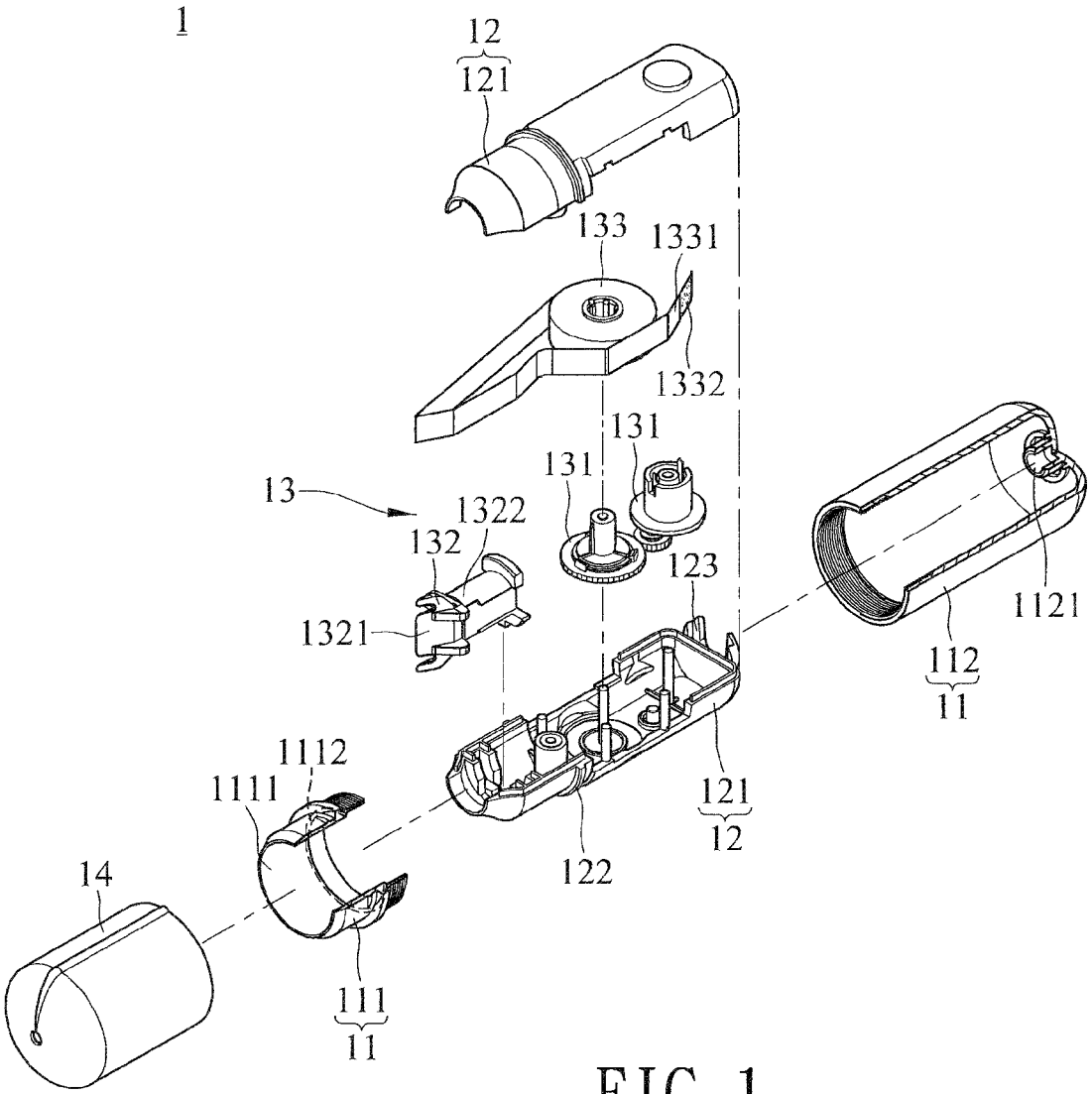
FIG. 1 is an exploded view of a first preferred embodiment of the present invention.
Figure 2:
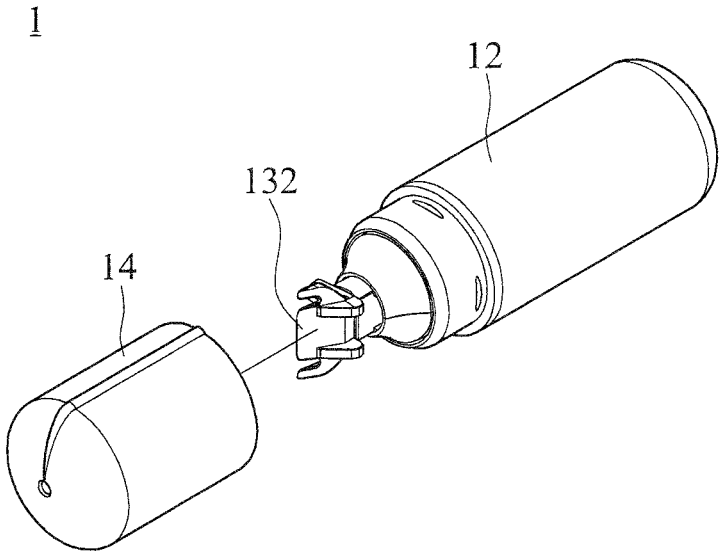
FIG. 2 is a perspective view of the first preferred embodiment of the present invention.
Figure 3:
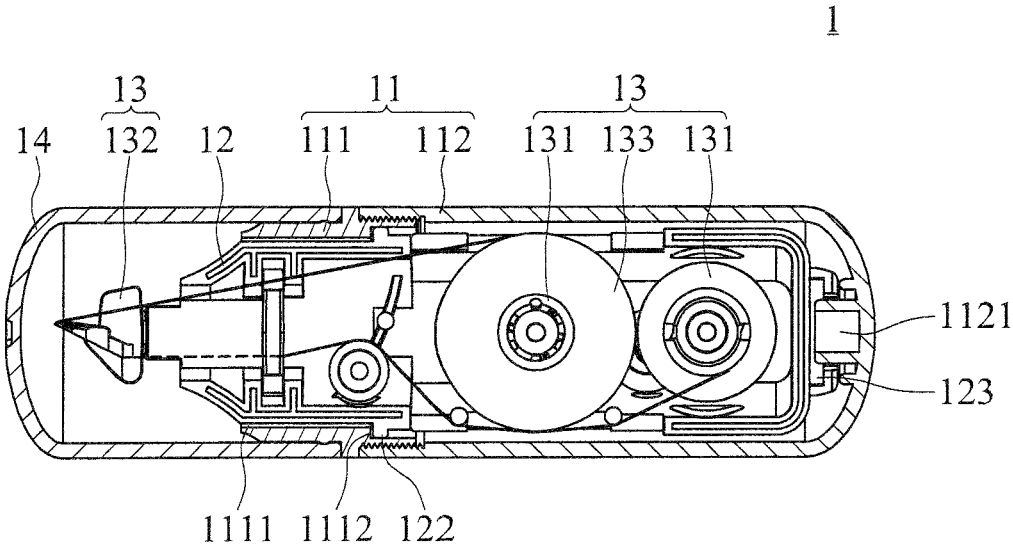
FIG. 3 is a schematic view of an application of the first preferred embodiment of the present invention.

With reference to FIGS. 1 to 3 for an exploded view, a perspective view and a schematic view of an application of the first preferred embodiment of the present invention respectively, an automatic rotation type correction tape structure 1 of the present invention comprises an outer casing 11, an inner casing 12, a tape delivery module 13 and a cap 14.

The outer casing 11 is a tubular structure with a closed end and formed by a front socket 111 and a rear tube 112, and the front socket 111 has an opening 1111 formed at an end of the front socket 111, and a circular top abutting surface 1112 formed on an inner wall of the front socket 111, and the rear tube 112 has a positioning portion 1121 disposed at the exterior of a closed end at an end section of the rear tube 112.

The inner casing 12 is formed by engaging two half casings 121 and a containing space (not shown in the figure) is defined in the inner casing 12, and the inner casing 12 is movably installed in the outer casing 11, and the inner casing 12 has an engaging structure 122 corresponding to the top abutting surface 1112, and the engaging structure 122 is disposed around a circular ring structure of the inner casing 12 and provided for abutting the top abutting surface 1112, such that the inner casing 12 can be rotated axially with respect to the outer casing 11. In addition, a positioning slot 123 is formed at an end of the inner casing 12 and corresponding to the positioning portion 1121. After the inner casing 12 is assembled into the outer casing 11, the positioning portion 1121 is contained in the positioning slot 123, such that a multi-point supporting effect can be achieved between the inner casing 12 and the outer casing 11 to provide a stable rotation.

The tape delivery module 13 is installed in the containing space of the inner casing 12 and comprises: at least one pair of winding wheels 131 installed at an end of the inner casing 12, and the winding wheels 131 is linked by a gear portion or any other transmitting component (not shown in the figure) to rotate in the same direction synchronously; a tape guiding spout 132 disposed on a side of the inner casing 12 and passed out from the inner casing 12 and the outer casing 11, and the tape guiding spout 132 has an oblique plane portion 1321, and a fine-tune structure 1322 is installed between the tape guiding spout 132 and the inner casing 12, so that the angle of the tape guiding spout 132 with respect to the inner casing 12 can be adjusted slightly; and a correction tape 133 formed by adhering a surface material 1331 and a bottom material 1332 with one another, and both ends of the correction tape 133 are wound around the winding wheels 131 and wound through the tape guiding spout 132, wherein the surface material 1331 is wound around one of the winding wheels 131, and the bottom material 1332 is wound around the other winding wheel 131, and the correction tape 133 is wound through the tape guiding spout 132, so that the surface material 1331 is attached onto a desired plane through the tape guiding spout 132, and the bottom material 1332 is retracted by the other winding wheel 131.

The cap 14 is installed at the opening 1111 of the outer casing 11 and provided for covering the outer casing 11 and the tape guiding spout 132.

Figure 4:
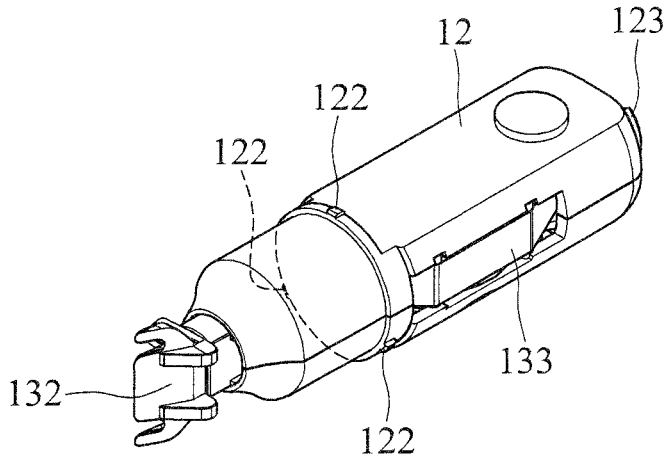
FIG. 4 is a schematic view of another example of the first preferred embodiment of the present invention.

With reference to FIG. 4 for a schematic view of another example in accordance with the first preferred embodiment of the present invention, the engaging structure 122 of the inner casing 12 comprises a plurality of bumps, and the bumps are disposed axially and uniformly on an outer wall of the inner casing 12 to uniformly abut the top abutting surface 1112 to decrease the abutting area between the engaging structure 122 and the top abutting surface 1112, so as to reduce the friction force produced during the rotation, so that the inner casing 12 can be rotated in the outer casing 11 more easily.

Figure 5:
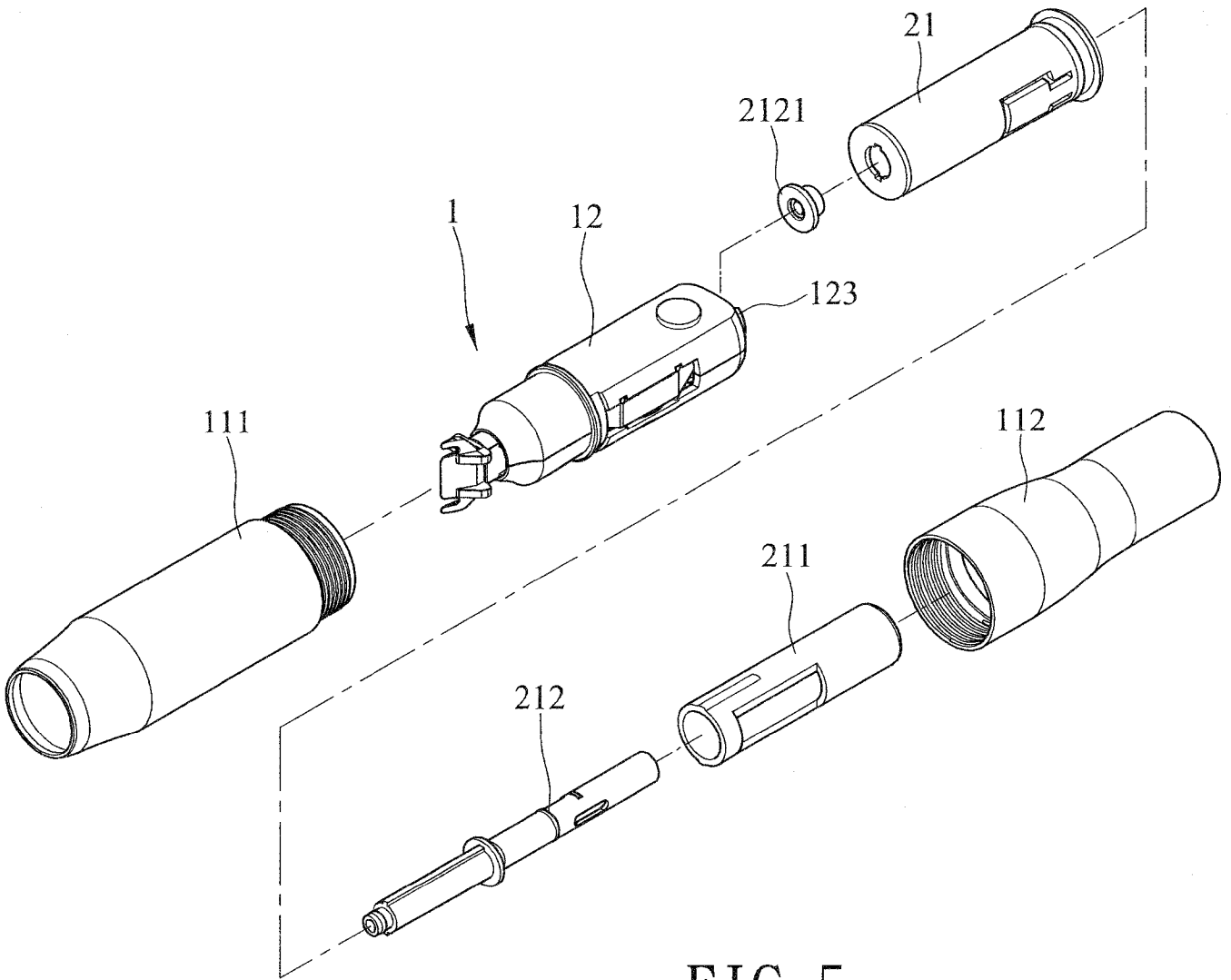
FIG. 5 is an exploded view of a second preferred embodiment of the present invention.
Figure 6:
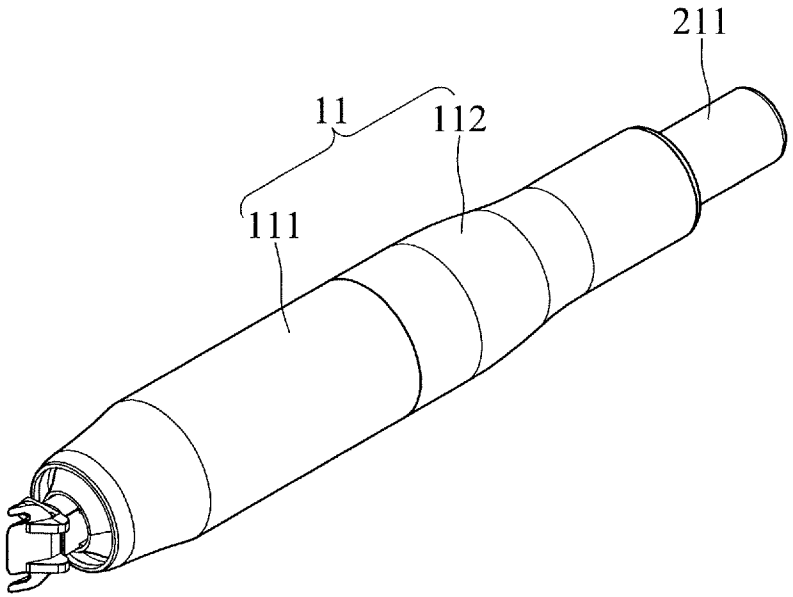
FIG. 6 is a perspective view of the second preferred embodiment of the present invention.
Figure 7:
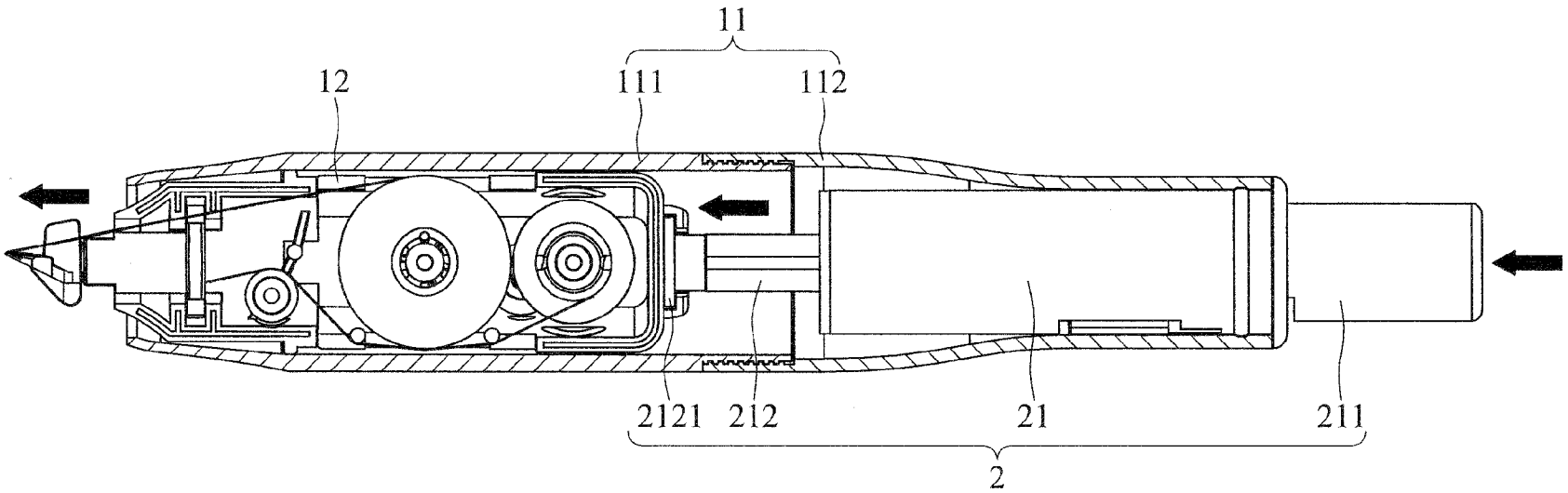
FIG. 7 is a cross-sectional view of an assembly in accordance with the second preferred embodiment of the present invention.

With reference to FIGS. 5 to 7 for an exploded view, a perspective view and a cross-sectional view of a preferred embodiment of the present invention respectively as well as the aforementioned drawings, this preferred embodiment is based on the previous preferred embodiment and combined with a pressing device 2, wherein the front socket 111 and the rear tube 112 of the outer casing 11 have an opening separately, and the pressing device 2 has an outer tube 21 installed in the rear tube 112, and a press key 211 is installed at an end of the outer tube 21 and exposed from the rear tube 112, and a top rod 212 is installed the other end of the outer tube 21, and the press key 211 and the top rod 212 are coupled to one another, and an end of the top rod 212 is coupled to the inner casing 12. After the press key 211 is pressed, the top rod 212 is driven to push the inner casing 12 to move, so that the tape guiding spout 132 is passed out from the opening 1111 of the outer casing 11. In addition, the top rod 212 has a buckle portion 2121 disposed at an end of the top rod 212 and corresponding to the positioning slot 123, and the buckle portion 2121 is disposed in the positioning slot 123 to facilitate engaging the inner casing 12 and the top rod 212 together.

In summation, when the automatic rotation type correction tape structure 1 of the present invention is used, the tape guiding spout 132 is pressed onto a plane according to a user's posture to drive the tape delivery module 13 and the inner casing 12 to rotate axially and synchronously in the outer casing 11 and quickly and automatically change the using angle of the tape guiding spout 132 in order to fit the user's operating posture and improve the convenience of use significantly. In addition, the pressing device 2 is used to drive the top rod 212 to extend or contract, so that the automatic rotation type correction tape structure 1 has the extending and contracting functions for the use or storage. Obviously, the present invention can improve the practicality and convenience.

What is claimed is:

1. An automatic rotation type correction tape structure, comprising:

an outer casing, being a circular tubular structure, and having an opening, and a circular top abutting surface formed inside the outer casing and proximate to the opening;

an inner casing, movably installed in the outer casing, and having an engaging structure corresponding to the top abutting surface, and abutted against the top abutting surface, such that the inner casing can be axially rotated with respect to the outer casing, and the inner casing having a containing space therein; and a tape delivery module, installed in the containing space of the inner casing, and further comprising:

at least one pair of winding wheels, installed at an end of the inner casing and linked with each other to rotate synchronously;

a tape guiding spout, installed on a side of the inner casing and passed out from the inner casing and the outer casing, and the tape guiding spout having an oblique plane portion; and a correction tape, having two ends wound around the winding wheels respectively, and wound through the oblique plane portion of the tape guiding spout to press at the correction tape, wherein the engaging structure is disposed around a circular ring structure of the inner casing to abut the top abutting surface.

2. The automatic rotation type correction tape structure of claim 1, wherein the outer casing includes a positioning portion, and the inner casing includes a positioning slot corresponding to the positioning portion, and the positioning portion is contained in the positioning slot.

3. The automatic rotation type correction tape structure of claim 2, further comprising a pressing device installed on the outer casing, and the pressing device having an outer tube, a top rod and a press key, and the top rod being movably passed inside the outer tube, and the press key being disposed at an end of the top rod, and the other end of the top rod being coupled to the inner casing, such that after the press key is pressed, the top rod is linked to push the inner casing to move, and the tape guiding spout is passed out from the opening of the outer casing.

4. The automatic rotation type correction tape structure of claim 3, wherein the top rod includes a buckle portion disposed at the other end of the top rod and corresponding to the positioning slot, and the buckle portion is disposed in the positioning slot.

5. The automatic rotation type correction tape structure of claim 1, wherein the correction tape is formed by adhering a surface material and a bottom material with each other, and the surface material is wound on one of the winding wheels, and the bottom material is wound on the other winding wheel, and the correction tape is wound through the oblique plane portion of the tape guiding spout.

6. The automatic rotation type correction tape structure of claim 1, further comprising a cap covered onto the opening of the outer casing to seal the tape guiding spout.

7. An automatic rotation type correction tape structure, comprising:

an outer casing, being a circular tubular structure, and having an opening, and a circular top abutting surface formed inside the outer casing and proximate to the opening;

an inner casing, movably installed in the outer casing, and having an engaging structure corresponding to the top abutting surface, and abutted against the top abutting surface, such that the inner casing can be axially rotated with respect to the outer casing, and the inner casing having a containing space therein; and a tape delivery module, installed in the containing space of the inner casing, and further comprising:

at least one pair of winding wheels, installed at an end of the inner casing and linked with each other to rotate synchronously;

a tape guiding spout, installed on a side of the inner casing and passed out from the inner casing and the outer casing, and the tape guiding spout having an oblique plane portion; and a correction tape, having two ends wound around the winding wheels respectively, and wound through the oblique plane portion of the tape guiding spout to press at the correction tape, wherein the engaging structure comprises a plurality of bumps, and the bumps uniformly disposed in a radial direction of an external wall of the inner casing to uniformly abut the top abutting surface.

8. The automatic rotation type correction tape structure of claim 7, wherein the outer casing includes a positioning portion, and the inner casing includes a positioning slot corresponding to the positioning portion, and the positioning portion is contained in the positioning slot.

9. The automatic rotation type correction tape structure of claim 8, further comprising a pressing device installed on the outer casing, and the pressing device having an outer tube, a top rod and a press key, and the top rod being movably passed inside the outer tube, and the press key being disposed at an end of the top rod, and the other end of the top rod being coupled to the inner casing, such that after the press key is pressed, the top rod is linked to push the inner casing to move, and the tape guiding spout is passed out from the opening of the outer casing.

10. The automatic rotation type correction tape structure of claim 9, wherein the top rod includes a buckle portion disposed at the other end of the top rod and corresponding to the positioning slot, and the buckle portion is disposed in the positioning slot.

11. The automatic rotation type correction tape structure of claim 7, wherein the correction tape is formed by adhering a surface material and a bottom material with each other, and the surface material is wound on one of the winding wheels, and the bottom material is wound on the other winding wheel, and the correction tape is wound through the oblique plane portion of the tape guiding spout.

12. The automatic rotation type correction tape structure of claim 7, further comprising a cap covered onto the opening of the outer casing to seal the tape guiding spout.

* * * * *